United States Patent [19]

Kadle

[11] Patent Number: 4,958,681

[45] Date of Patent: Sep. 25, 1990

[54] HEAT EXCHANGER WITH BYPASS CHANNEL LOUVERED FINS

[75] Inventor: Durgaprasad S. Kadle, Getzville, N.Y.

[73] Assignee: General Motors Corporation, Detroit, Mich.

[21] Appl. No.: 393,157

[22] Filed: Aug. 14, 1989

[51] Int. Cl.[5] ..... F28D 1/04; F28F 1/32

[52] U.S. Cl. ..... 165/151; 165/152; 165/181

[58] Field of Search ..... 165/151, 152, 153, 181, 165/182

[56] References Cited

U.S. PATENT DOCUMENTS

| | | | |
|---|---|---|---|
| 2,006,649 | 7/1935 | Modine | 165/151 |
| 3,250,325 | 5/1966 | Rhodes et al. | 165/153 |
| 3,265,127 | 8/1966 | Nickol et al. | 165/152 |
| 3,724,538 | 4/1973 | Yamaguchi et al. | 165/152 |
| 4,332,293 | 6/1982 | Hiramatsu | 165/153 |
| 4,434,844 | 3/1984 | Sakitani et al. | 165/151 |
| 4,615,384 | 10/1986 | Shimada et al. | 165/152 |
| 4,693,307 | 9/1987 | Scarselletta | 165/152 |
| 4,723,599 | 2/1988 | Hanson | 165/151 |
| 4,756,362 | 7/1988 | Kudoh et al. | 165/151 |

FOREIGN PATENT DOCUMENTS

| | | | |
|---|---|---|---|
| 2108688 | 9/1972 | Fed. Rep. of Germany | 165/152 |
| 2123723 | 12/1972 | Fed. Rep. of Germany | 165/151 |
| 2518226 | 11/1975 | Fed. Rep. of Germany | 165/151 |
| 0194194 | 8/1987 | Japan | 165/151 |

*Primary Examiner*—John Ford

*Attorney, Agent, or Firm*—Ronald L. Phillips

[57] ABSTRACT

Louvered fins in fin and tube type heat exchangers extend across the spaces between adjacent tubes. Adjacent tubes are separated by a distance s and louvers in the fins extend between the tubes but stop short of the tubes to leave some plain fin area which defines a bypass channel of width b between each tube and adjacent louvers. The curve of heat transfer versus air side pressure drop increases as the ratio b/s decreases. An optimum value of b/s occurs at the knee of the curve and lower values of the ratio effect insignificant improvements in heat transfer.

2 Claims, 2 Drawing Sheets

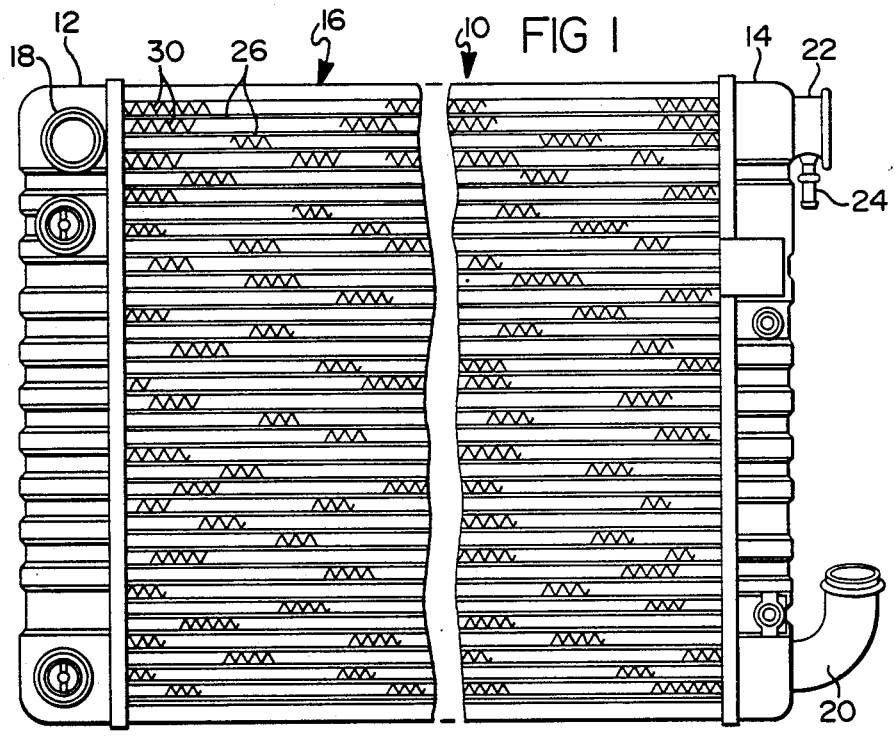
FIG 1
FIG 2
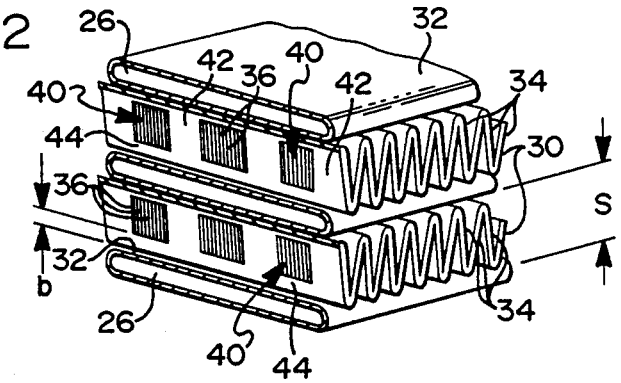
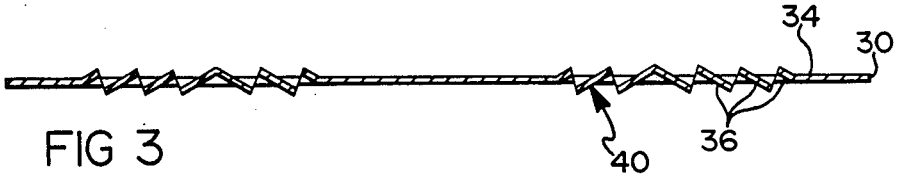
FIG 3

HEAT EXCHANGER WITH BYPASS CHANNEL LOUVERED FINS

FIELD OF THE INVENTION

This invention relates to heat exchangers and particularly to louvered fin arrangements therefor

BACKGROUND OF THE INVENTION

Heat exchangers of the type used for radiators in vehicle engine cooling systems or condensers in vehicle air conditioning systems utilize tubes carrying a coolant or refrigerant and fins between the tubes to effectively increase the contact with air for heat transfer to the air. Often louvers are incorporated in the fins to improve the heat transfer efficiency and thereby decrease the necessary core size. For example, the U.S Pat. No. 2,006,649 to Modine shows a heat exchanger having a plurality of parallel tube, either flat or round, and fins surrounding the tubes. The fins take several configurations including flat fins with louvers The U.S. Pat. No. 3,250,325 to Rhodes, et al., shows a heat exchanger with corrugated fins between adjacent tubes and louvers in the fins disposed between the tube but spaced somewhat from the tubes. Typically, compact heat exchangers utilize extended fin surface area to increase spatial efficiency with the heat transfer performance tending to be enhanced as the fin density increased provided sufficient working fluid (air) mass flow rate is maintained across the extended fin surface. As seen in the above louvered fin designs, various arrangements of consecutive multiple louvers have been utilized to create turbulence in the working fluid; the theory being that such added turbulence increases the convection heat transfer coefficient resulting in increased heat transfer by insuring maximum temperature differential between the extended surface and the working fluid (air). Although the louvers do increase the heat transfer performance of an extended surface fin at a constant air mass flow rate, such increase is typically gained at the expense of air pressure drop.

In U.S. Pat. No. 4,693,307 to Scarseletta, which is incorporated herein by reference, it is revealed that particular fin arrangements can be used to take advantage of both plain fin designs and louvered designs to have both high heat transfer performance and low air side pressure drop at a constant air mass flow. According to that patent, a tube and fin heat exchanger like that shown in FIG. 1 can be equipped with hybrid fins having louvered sections separated by plain fin sections as shown in FIGS. 2 and 3.

SUMMARY OF THE INVENTION

It is the general practice, when employing louvered fins, to extend the louvers as near to the fin/tube interface as is allowed by the manufacturing constraints. It has been found, however, that a bypass channel separating the louver from the fin is beneficial from the standpoint of significantly lowering the air side pressure drop while penalizing the heat transfer efficiency only slightly Since the bypass channels around the tubes provide more air flow close to the tubes from which the heat is to be transferred, the heat transfer from the tubes tends to be increased. However the plain surface on the fin in the bypass channel is less effective than a fin so that the heat transfer tends to be reduced. The combined effect of the two phenomena is to keep the total heat transfer constant within a certain range of bypass channel widths. On the other hand, the bypass of air around the tubes lowers the total air side pressure drop for a given air mass flow.

Accordingly, it is an object of the invention to provide a heat exchanger having louvered fins with a bypass channel around the tubes of the optimum width to minimize air side pressure drop while realizing the advantages of the louvers.

BRIEF DESCRIPTION OF THE DRAWINGS

The above and other advantages of the invention will become more apparent from the following description taken in conjunction with the accompanying drawings wherein like references refer to like parts and wherein:

FIG. 1 is a front view of a flat tube and fin radiator for a motor vehicle's engine cooling system and there is incorporated therewith one embodiment of the bypass channel louvered fin arrangement according to the invention, FIG. 2 is an isometric view of a section of the radiator core of FIG. 1 illustrating a louvered corrugated fin and its relationship to the tubes, FIG. 3 is an enlarged cross-sectional view through a louvered fin of FIG. 2.

DESCRIPTION OF THE INVENTION

Figure 4:
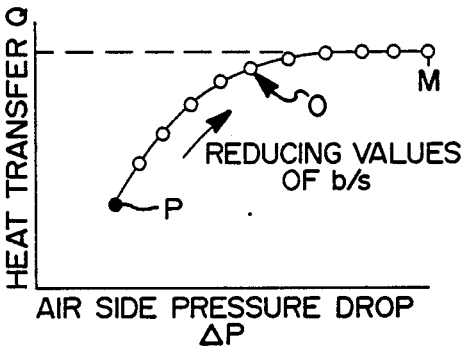
FIG. 4 is a graph of heat transfer versus air side pressure drop for various values of bypass channel width to tube spacing ratios.

While FIGS. 1, 2 and 3 are similar to those used in the above mentioned U.S. Pat. No. 4,693,307 to describe the particular features of that invention they are useful with particular modifications in conjunction with the description and the other figures to illustrate an embodiment of this invention.

In FIG. 1, there is shown a flat tube and fin crossflow radiator generally designated as 10 used in the engine cooling system of a motor vehicle. The radiator basically comprises a pair of vertically oriented tanks 12 and 14 interconnected by a horizontally oriented liquid-to-air heat exchanger core 16 of flat tube and fin construction. The tanks 12 and 14 have an inlet pipe 18 and outlet pipe 20, respectively, by which the radiator is connected in the cooling system with the tank 14 additionally having a fill pipe 22 and connected overflow pipe 24 by which the cooling system is filled and allowed to overflow, respectively.

The core 16 comprises a plurality of flat tubes 26 interconnecting the tanks 12 and 14 for liquid flow therebetween from the radiator inlet pipe 18 located at the top of tank 12 to the radiator outlet pipe 20 located at the bottom of the other tank 14. The flat tubes 26 are arranged side-by-side in one or more rows across the width of the core with FIG. 2 showing a one-row arrangement. The space between the flat sides 32 of adjacent sets of tubes is a distance "s". For increased heat transfer performance, the core 16 is additionally provided with fins or air centers preferably formed by corrugated strips 30 singularly arranged between the opposed flat sides 32 of each adjacent set of tubes. The strips are bonded at their crests to the respective tubes for intimate heat transfer relationship therewith and are formed so as to define in the air space between each adjacent set of tubes a series or stack of distinct fins or air centers 34 extending between adjacent crests of the corrugations in each strip that are spaced side-by-side parallel to each other and at right angles to the tubes.

As shown in FIGS. 2 and 3, the fins 34 have louvers 36 arranged in groups 40 separated by plain surfaces 42 and moreover separated from the tube sides 32 by plain surfaces 44 forming channels of width "b" for air to bypass the louvers 36. Although the separated groups of louvers is preferred for the reasons given in U.S. Pat. No. 4,693,307, in some cases the groups 40 of louvers on each fin are supplanted by a single continuous louver group extending nearly edge-to-edge across the fin. In either case, the plain surfaces comprising bypass channels 44 will be present.

In the past it has been the practice to minimize the width "b" of the channels 44 to the extent practical to manufacture on the theory that the louver area should be maximized. It is now proposed that the air flow immediately adjacent the tube surface 32 should be encouraged to facilitate direct heat transfer from the tube 26 to the air. In particular, it has been discovered that for small channel widths the heat transfer efficiency is not decreased by sacrificing louver area in favor of channel size while the air side pressure drop does decrease as the channel becomes larger. This relationship is illustrated in FIG. 4 which charts heat transfer Q against air side pressure drop (delta P) for different ratios of channel width to tube separation, b/s at a constant air mass flow. For a plain fin with no louvers 2b=s: this is shown at point P on the graph as providing both low air pressure drop and low heat transfer. As the bypass channel width "b" and thus the ratio b/s decreases the heat transfer increases as well as the pressure drop until the knee of the curve is reached at the optimum range 0. Thereafter, as the ratio b/s approaches zero, the pressure drop continues to increase but the change in heat transfer is minimal Thus the curve asymptotically approaches a maximum Q. In that region above the optimum range 0 the possible gain in heat transfer is minimal while the change in pressure drop is relatively large. Thus the preferred bypass channel design is one which allows the lowest pressure drop without significant sacrifice in heat transfer. The optimum point then is in the range 0. The optimum may be defined as the range in which the heat transfer is on the order of 95% of the highest heat transfer possible for this configuration. For this flat tube and fin structure, the optimum ratio b/s is in a range of 0.12 to 0.18 and preferably is 0.15.

Figure 5:
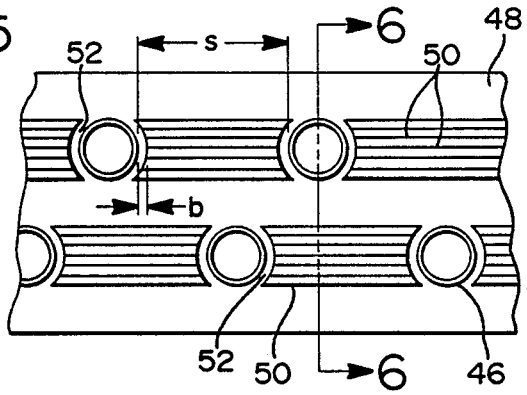
FIG. 5 is a top view cross-sectional view of a wrap-around multilouver fin and staggered tube structure for a heat exchanger according to another embodiment of the invention.
Figure 6:
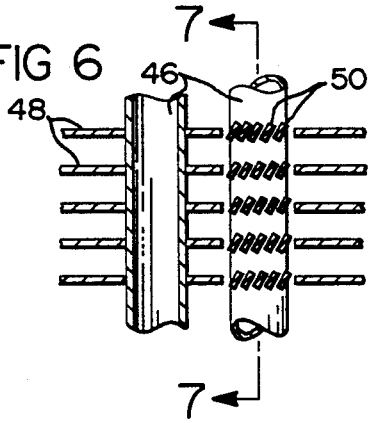
FIG. 6 is a cross-sectional view of the wrap-around multilouver fin and tube structure taken along line 6—6 of FIG. 5.
Figure 7:
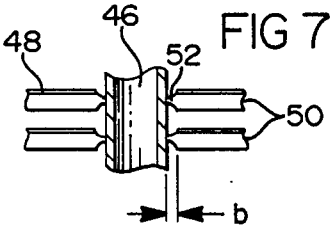
FIG. 7 is a cross—sectional view of the wrap around fin and tube structure taken along line 7—7 of FIG. 6.

A similar analysis applies to another common type of heat exchanger known as a wrap-around multilouver fin and tube structure which is shown in FIGS. 5, 6 and 7. A plurality of parallel round tubes, shown here in two staggered rows, carry coolant or refrigerant and are surrounded by air and by flat fins 48 to facilitate heat transfer between the air and the tubes 46. Each fin 48 is apertured to surround every tube 46 and is bonded to each tube by brazing or the like to insure thermal coupling of the tubes and fins. Groups of louvers 50 formed in the fins lie between the tubes 46 with the louvers extending perpendicular to the nominal air flow direction. The groups of louvers 50 are separate for each row and stop short of the tubes to define arcuate plain fin areas or bypass channels 52. In FIG. 7 the function of the bypass channel 52 is clearly presented; that is, it allows a relatively unimpeded flow passage in contrast to the louvers 50 which present some restriction to free air flow. The tube separation "s" is the closest distance between adjacent tubes in the same row. The ratio of bypass channel width "b" to tube spacing "s" has the same significance in this embodiment as in the structure of FIGS. 2 and 3. The graph of FIG. 4 also applies to the latter embodiment although the scales may be different. Thus the operation of the heat exchanger is optimized by selecting a channel width "b" which is in the optimum range 0 of the curve of heat transfer versus air side pressure drop. Empirical data taken on the wrap-around fin and tube structure at a front end air flow of 50 mph indicates that the optimum range of the ratio b/s is 0.12 to 0.18 with a preferred value of 0.15.

The embodiments of the invention in which an exclusive property or privilege is claimed are defined as follows:

1. A heat exchanger having a plurality of round tubes and a plurality of wrap-around multilouver fins between the tubes and thermally coupled to the tubes for enhancing the heat transfer capacity of the heat exchanger, the fins comprising louvers and plain sections, the louvers being placed between pair of tubes and spaced from those on an adjacent fin section and also spaced from the tubes by arcuate plain sections of uniform width serving as arcuate bypass channels of uniform width, the ratio of the width of the arcuate bypass channels to the distance between adjacent tubes having an optimum value, the louvers having the effect of increasing heat transfer and increasing air side pressure drop of the heat exchanger such that the curve of heat transfer versus air side pressure drop increases as the said ratio decreases, the curve having a knee above which a decreasing ratio yields an insignificant increase in heat transfer, the said optimum value of said ratio being at the knee of the curve to thereby optimize the heat transfer property without invoking high air side pressure drop.

2. A heat exchanger having a plurality of round tubes and a plurality of wrap-around multilouver fins transverse to the tubes, each fin surrounding and thermally coupled to the tubes for enhancing the heat transfer capacity of the heat exchanger, the fins comprising louvers and plain sections, the louvers being located between pairs of tubes and spaced from those on an adjacent fin section and also spaced from the tubes by arcuate plain sections serving as arcuate bypass channels having a uniform width b, the adjacent tubes being separated by a distance s, and the radio b/s having an optimum value, the louvers having the effect of increasing heat transfer and increasing air side pressure drop of the heat exchanger such that the curve of heat transfer versus air side pressure drop increases as th said ratio decreases, the curve having a knee above which a decreasing ratio yields an insignificant increase in heat transfer, the said optimum value of the ratio b/s being at the knee of the curve to thereby optimize the heat transfer property without invoking a high air side pressure drop.

* * * * *